US006551131B1

(12) United States Patent
Kuo

(10) Patent No.: US 6,551,131 B1
(45) Date of Patent: Apr. 22, 2003

(54) STACKED ELECTRICAL CARD CONNECTOR ASSEMBLY

(75) Inventor: Ming-Lun Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/023,619

(22) Filed: Dec. 17, 2001

(51) Int. Cl.[7] ..... H01R 13/66
(52) U.S. Cl. ..... 439/541.5; 361/737
(58) Field of Search ..... 439/64, 541.5, 439/67, 79, 630; 361/737, 684

(56) References Cited

U.S. PATENT DOCUMENTS 5,548,484 A * 8/1996 Kantner ..... 257/679
5,688,130 A * 11/1997 Huang ..... 439/541.5
6,015,092 A * 1/2000 Postlewaite et al. ..... 235/486
6,132,223 A * 10/2000 Seeley et al. ..... 439/377
6,176,724 B1 * 1/2001 Klatt et al. ..... 439/326
6,315,205 B1 * 11/2001 Bates, III ..... 235/479
6,330,151 B1 * 12/2001 Bates, III ..... 361/686

* cited by examiner

*Primary Examiner*—Tulsidas Patel
(74) *Attorney, Agent, or Firm*—Wei Te Chung

(57) ABSTRACT

A stacked electrical card connector assembly (1) includes an upper connector (10), a lower connector (20), and a flexible printed circuit (FPC) (30) connecting with both the upper connector (10) and the lower connector (20). The upper connector (10) comprises a metallic upper frame (12) having solder portions (1220). The lower connector (20) has a metallic lower frame (21). The upper frame (12) is stacked on the lower frame (21) with the solder portions (1220) being soldered on a base plate (22) of the lower frame (21).

16 Claims, 9 Drawing Sheets

STACKED ELECTRICAL CARD CONNECTOR ASSEMBLY

BACKGROUND OF THE INVENTION

1. Field of the Related Art

The present invention relates to the art of electrical connectors, more particularly to an improved electrical connector assembly for connecting two or more electrical cards to a printed circuit board (PCB).

2. Description of the Related Art

With the trend of reducing the size of a computer device, demand has arisen for increasing its data storage capacity at low cost. Generally, electrical cards, such as memory cards, are data storage devices which are electrically connected to the computer device. The electrical cards are portable instruments that are readily inserted and extracted from electrical connectors of the computer device. The connectors typically have sockets to receive the electrical cards therein and headers connected to the computer device such that data can be transferred therebetween.

Due to the ever-increasing demand in today's Notebook Personal Computer (Notebook-PC) for high-capacity signal transmission, more electrical card connectors are arranged in "dual port" or stacked configurations. Examples of this electrical connector assembly are disclosed in U.S. Pat. Nos. 5,324,204 and 5,688,130. This electrical connector assembly commonly includes an upper connector and a lower connector stacked together for receiving two electrical cards therein and electrically connecting the two electrical cards to a PCB. This electrical connector assembly meets the requirement of high-capacity data transmission since it can simultaneously receive two same or different types of electrical cards therein. However, the whole size of the electrical connector assembly is not reduced at all since the electrical connector assembly is manufactured by simply stacking two single electrical connectors together. It is not suitable to install such electrical connector assembly in a Notebook-PC for it occupies too much space. Furthermore, signal contacts defined independently in an upper header of the upper connector and a lower header of the lower connector have to be directly soldered to the PCB or connected to the PCB through an independent transition device soldered on the PCB. One problem associated with soldering the entire signal contacts of the connector assembly to the PCB is that it is difficult to solder each individual tail and ensure that none of the closely spaced solder pads is short circuited to an adjacent solder pad. In addition, if the connector assembly need be replaced or removed from the PCB, the unsoldering process is extremely labor intensive and costly.

SUMMARY OF THE INVENTION

Accordingly, an object of the present invention is to provide a stacked electrical connector assembly having reduced height thereby saving the occupied space on a PCB by the connector assembly.

Another object of the present invention is to provide a stacked electrical connector assembly with improved transition device which simplifies the assembling process of the connector assembly.

To achieve the above objects, a stacked electrical card connector assembly in accordance with the present invention comprises an upper connector, a lower connector, and a transition device respectively connected with the upper and lower connectors. The upper connector comprises a metallic upper frame having an opening defined therein with a plurality of spring arms extending oppositely in the opening. The upper frame also has a pair of flanges bending downwardly and inwardly from opposite side thereof with at least one solder portion defined at the flanges. The lower connector has an insulative lower header with a metallic shield covered on the lower header and a plurality of signal contacts defined in the lower header, and wherein the shield has a plurality of grounding pins extending out from one edge thereof. A lower metallic frame is connected with the lower header and soldered to the solder portion of the upper frame. The transition device has a first contacting portion and a second contacting portion. The first contacting portion is urged by the spring arms of the lower connector and the second contacting portion is connected with the signal contacts and grounding pins of the upper connector.

With such a design, data of different electrical cards received in the upper and lower connectors can be simultaneously transferred through one transition device thereby decreasing the whole height of the connector assembly. The transition device can be connected to a PCB without soldering the transition device to the PCB such that the assembling progress is simplified.

Other objects, advantages and novelty features of the invention will become more apparent from the following detailed description when taken in conjunction with the accompanying drawings. Two other copending applications having unknown serial numbers, the same title, the same applicant, the same assignee and the same filing date with the instant application, also disclose some other approaches to overcome the shortcoming of the prior art.

DESCRIPTION OF THE PREFERRED EMBODIMENT

Figure 1:
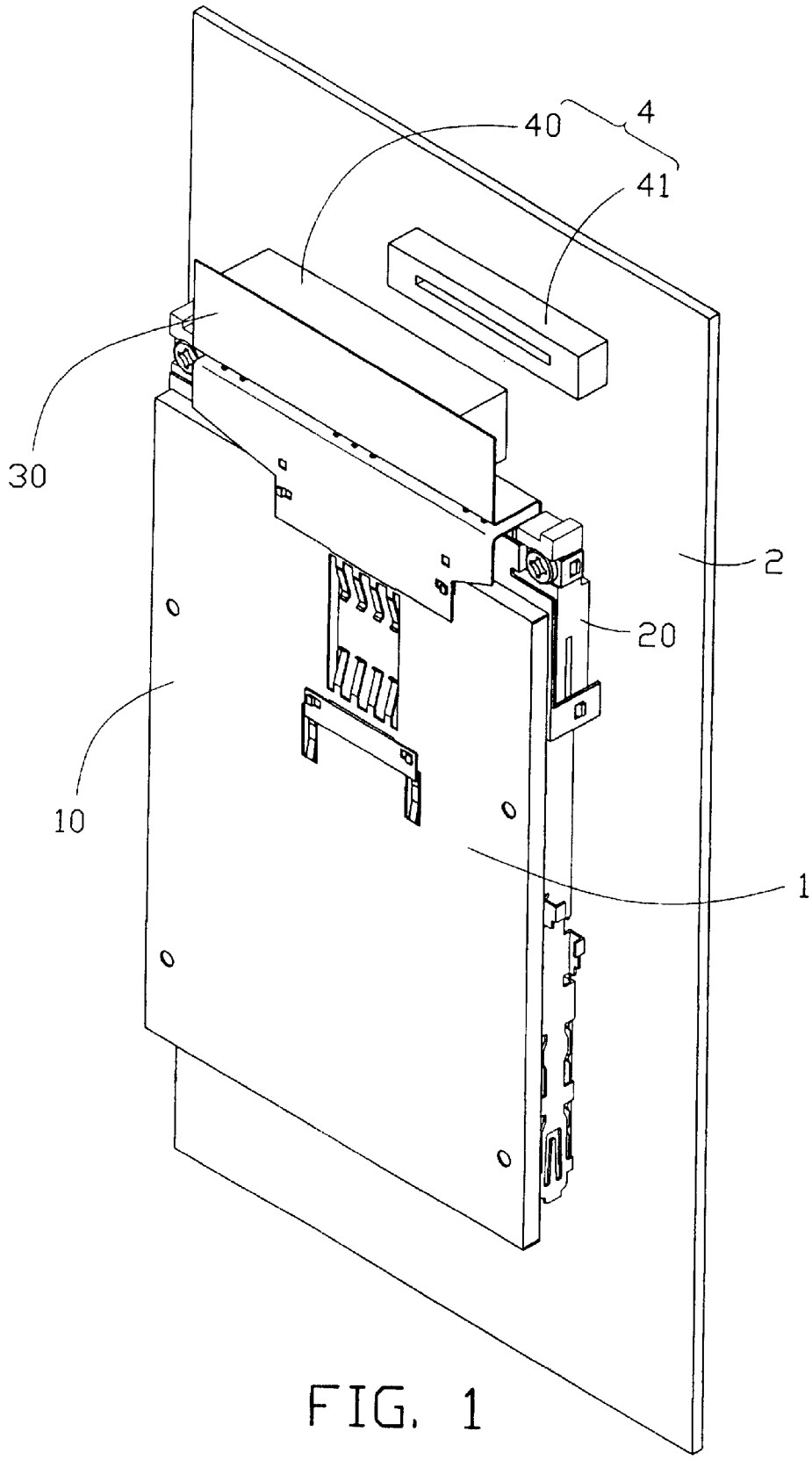
FIG. 1 is an assembled view of a stacked electrical connector assembly in accordance with a preferred embodiment of the present invention including a lower connector, an upper connector and a flexible printed circuit (FPC), in conjunction with a board-to-board connector and a PCB.

Reference will now be made to the drawing figures to describe the present invention in detail.

Referring to FIG. 1, a stacked electrical card connector assembly 1 in accordance with the present invention comprises an upper electrical connector 10, a lower connector 20, and a flexible printed circuit (FPC ) 30 for connecting both the upper connector 10 and the lower connector 20 with a printed circuit board (PCB) 2. The connector assembly 1 is mounted on the PCB 2 with a plug portion 40 of a board-to-board connector 4 connected with one end of the FPC 30, and a receptacle portion 41 of the connector 4 mounted on the PCB 2.

Figure 2:
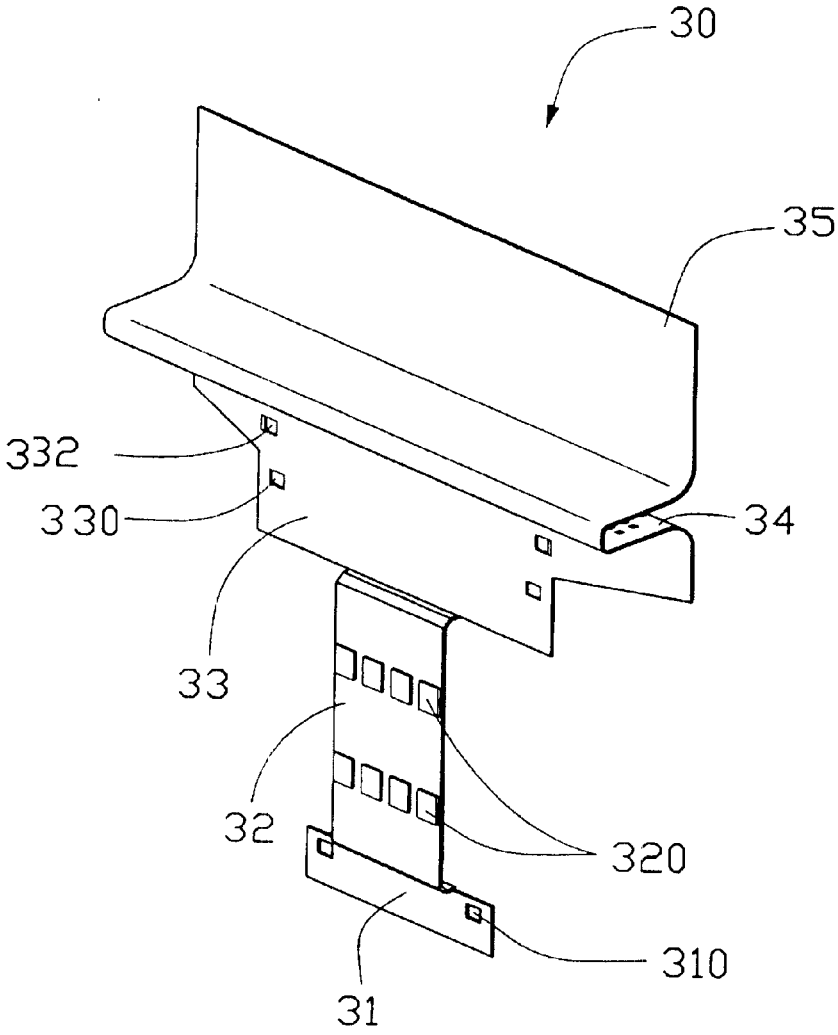
FIG. 2 is a perspective view of the FPC of FIG. 1, functioning as a transition device between electrical cards and the PCB.
Figure 3:
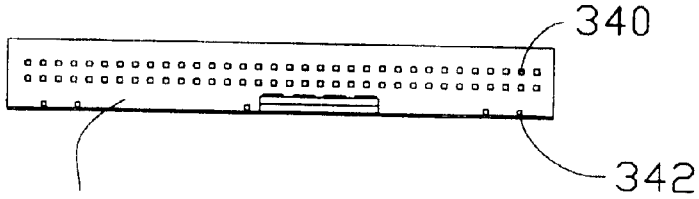
FIG. 3 is a cross-section view taken along line III—III of FIG. 2.

Referring to FIGS. 2 and 3, the FPC 30, functioning as a transition device, includes a first locking portion 31 defined in one end thereof, a tail portion 35 defined in the other end thereof, and a second locking portion 33 defined in a middle thereof. The first and second locking portions 31, 33 respectively define a plurality of securing holes 310, 330, 332 therein. A first contacting portion 32 is defined between the first and second locking portions 31, 33, and two rows of solder pads 320 are arranged on one side surface of the first contacting portion 32. A second contacting portion 34 is defined between the second locking portion 33 and the tail portion 35. The second contacting portion 34 is bent vertically to the second locking portion 33, and defines two rows of first solder holes 340 at one side near the second locking portion 33 and one row of second solder holes 342 at the other side near the tail portion 35.

Figure 4:
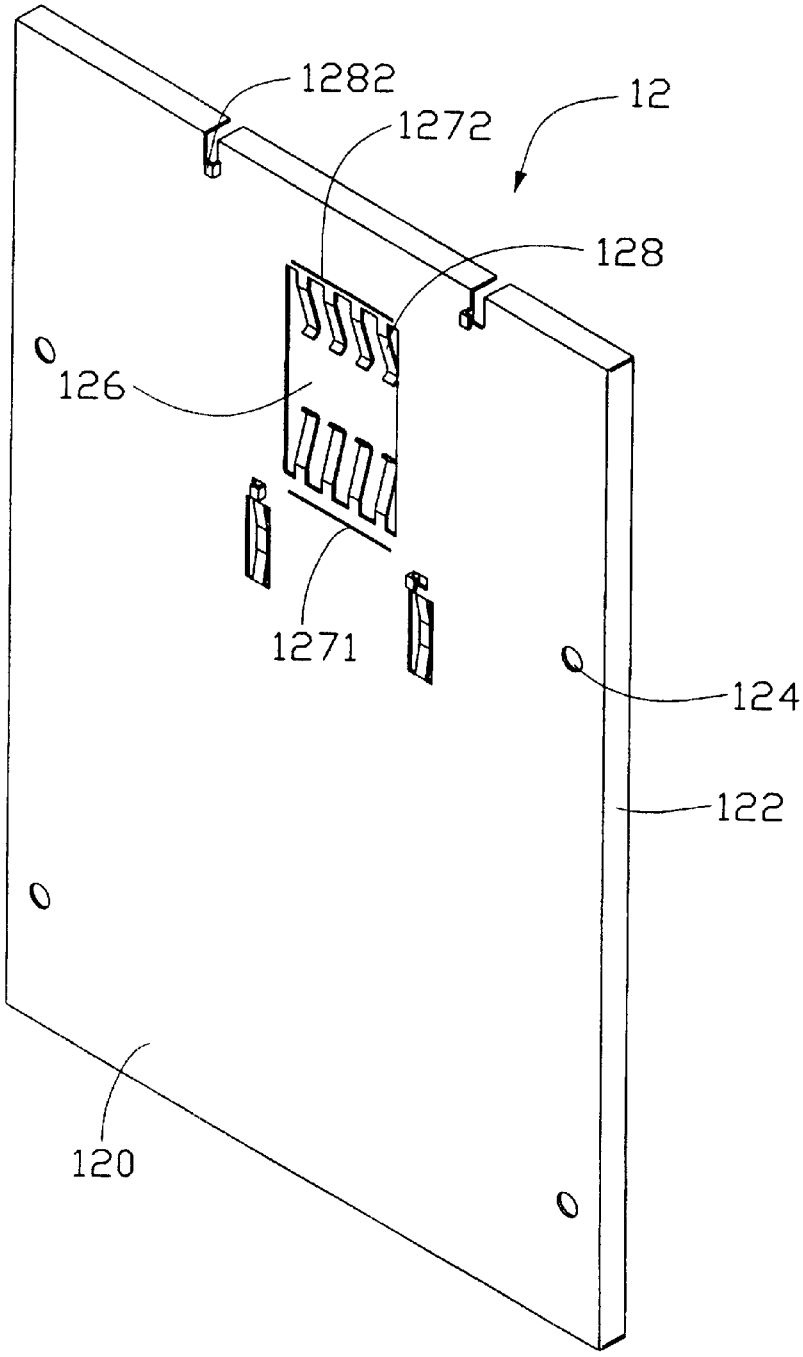
FIG. 4 is a perspective view of an upper frame of the upper connector of FIG. 1.
Figure 5:
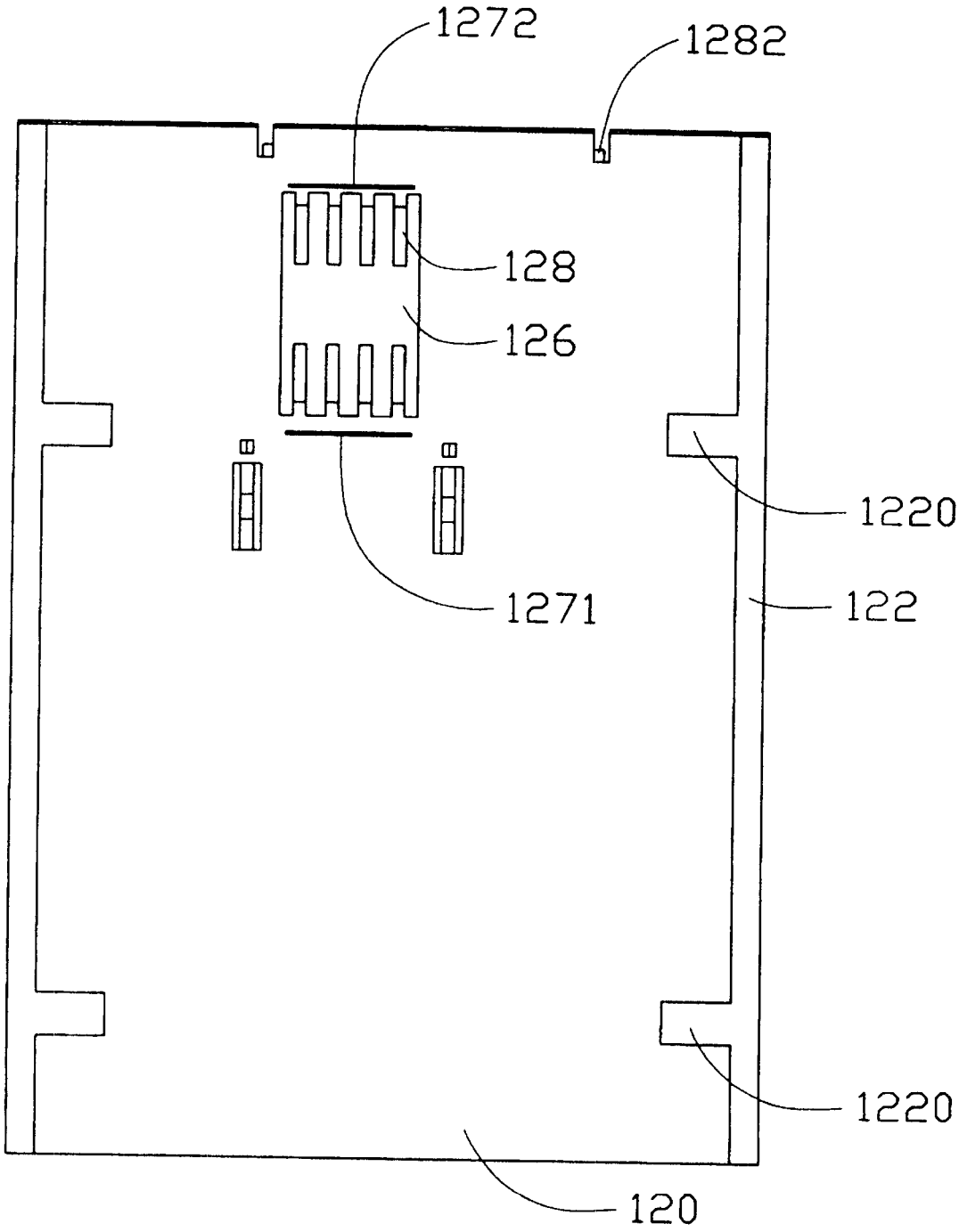
FIG. 5 is a bottom view of the upper frame of FIG. 4.

Referring to FIGS. 4 and 5, an upper frame 12 of the upper connector 10 is formed by stamping a metal sheet. The upper frame 12 has a flat base plate 120, opposite sides of the base plate 120 are bent vertically and inwardly to form a pair of flanges 122, and each flange 122 further inwardly extends a pair of spaced solder sheets 1220. Two pairs of through holes 124 are disposed in the base plate 120 and are right over the two pairs of solder sheets 1220 of the flange 122. The base plate 120 also defines an opening 126 near one inner end thereof, and two rows of spaced spring arms 128 extend oppositely in the opening 126 respectively from opposite sides of the opening 126. Two locating slots 1271, 1272 are respectively located behind both sides of the opening 126 where the spring arms 128 extend out. Two pairs of latches 1281, 1282 are respectively located behind the two slots 1271, 1272 such that the latches 1281, 1282 surround the opening 126 and the slots 1271, 1272.

Figure 6:
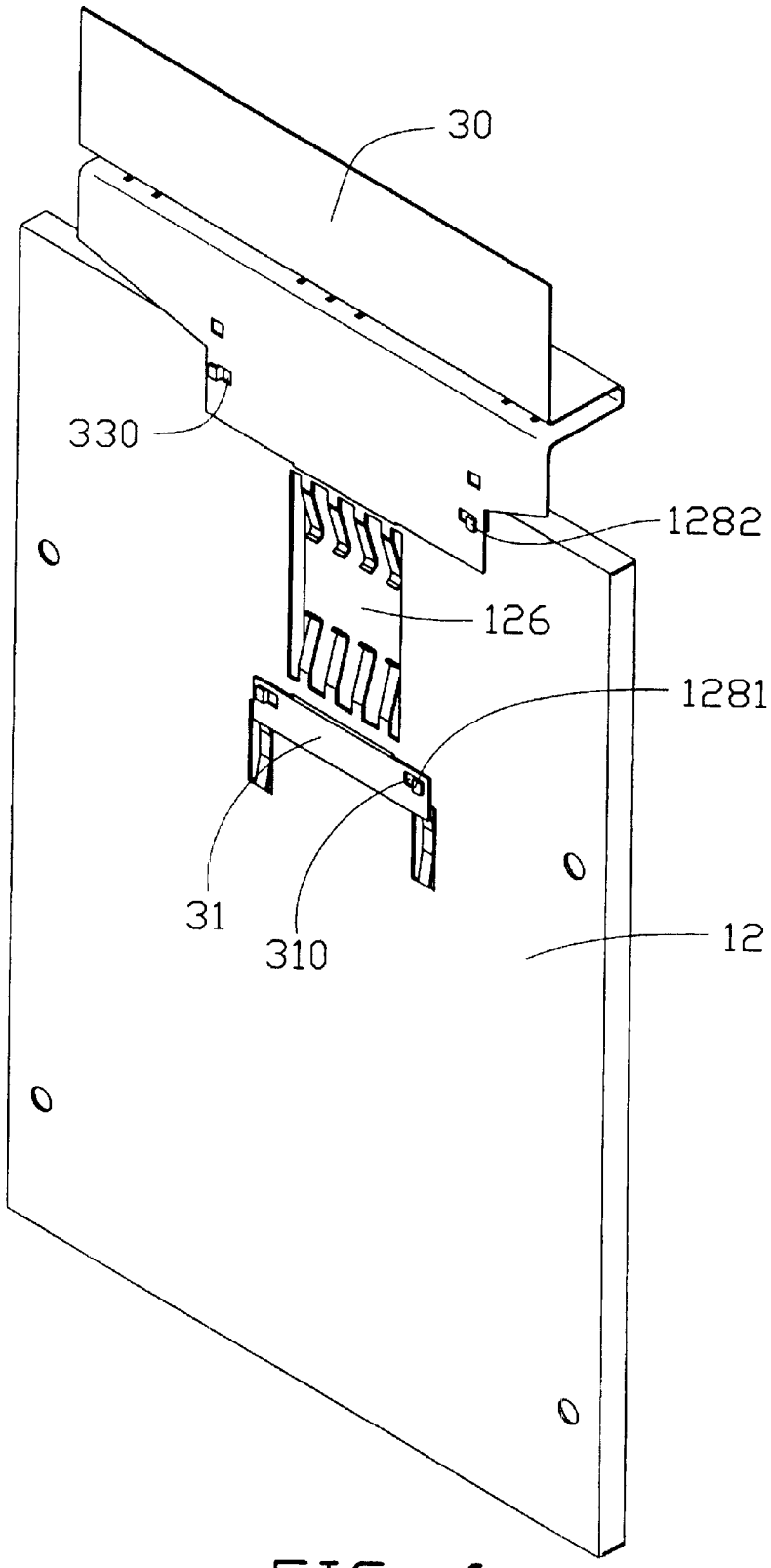
FIG. 6 is a perspective view showing the FPC of FIG. 2 assembled to the upper frame of FIG. 4.

FIG. 6 shows that the FPC 30 is assembled to the upper frame 12. The first locking portion 31 of the FPC 30 extends through the locating slot 1272, extends across the opening 126 along a bottom surface of the upper frame 12, finally extends upwardly through the locating slot 1271 from the bottom surface of the upper frame 12 with the securing holes 310 engagingly receiving the latches 1281. At this position, each spring arm 128 in the opening 126 resists a corresponding solder pad 320 from a reverse surface of the first contacting portion 32, and the securing holes 330 of the second locking portion 34 engagingly receive the latches 1282 of the upper frame 12. Thus, an electrical card received in the upper connector 10 can be communicated to outside through the FPC 30.

Figure 7:
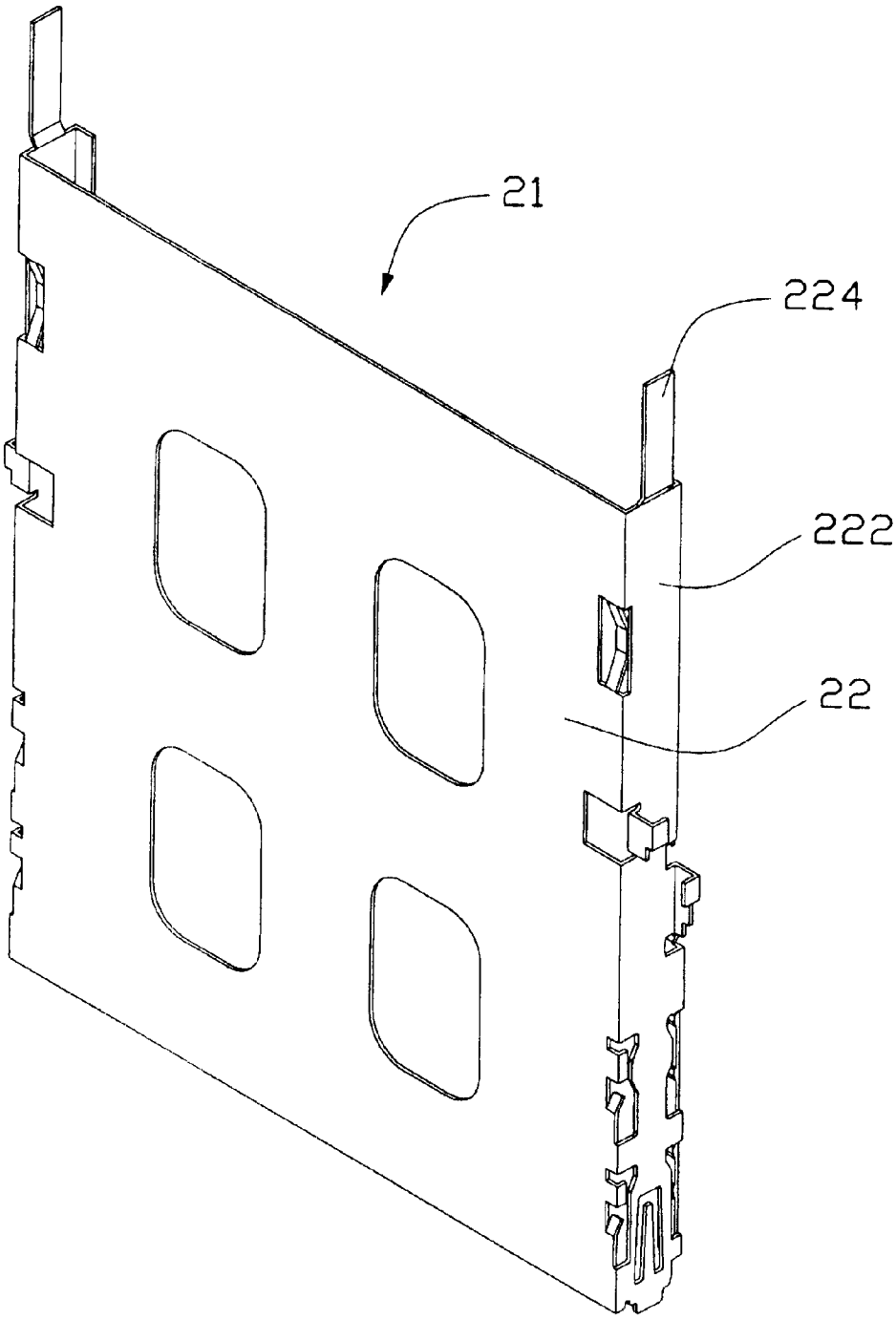
FIG. 7 is a perspective view of a lower frame of the lower connector of FIG. 1.
Figure 8:
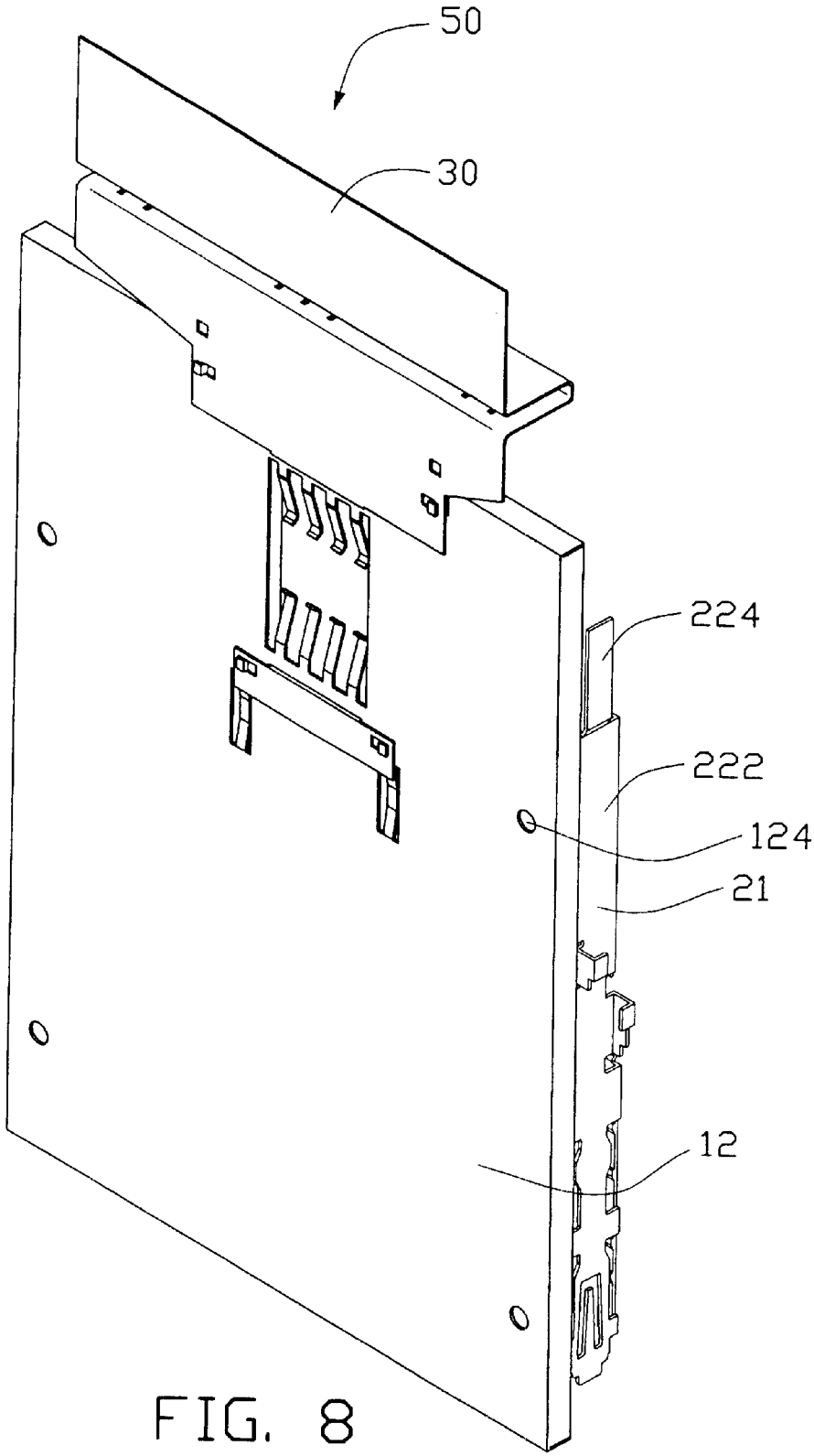
FIG. 8 is a perspective view showing the subassembly of FIG. 6 assembled on the lower frame of FIG. 7.

Referring to FIG. 7, a lower frame 21 of the lower connector 20, formed by stamping a metal sheet, comprises a flat base plate 22. Opposite sides of the base plate 22 are bent vertically and inwardly to form a pair of flanges 222, and each flange 222 further backwardly extends a locating sheet 224 along the flange 222. Referring to FIG. 8, the subassembly 50 is assembled on the lower frame 21 with the upper frame 12 being stacked on the lower frame 21. A solder tool (not shown) is then inserted into through holes 124 of the upper frame 12 and solders the solder sheet 1220 of the upper frame 12 on the base plate 220 of the lower frame 21 so as to secure the upper frame 12 on the lower frame 21 and form a subassembly 50.

Figure 9:
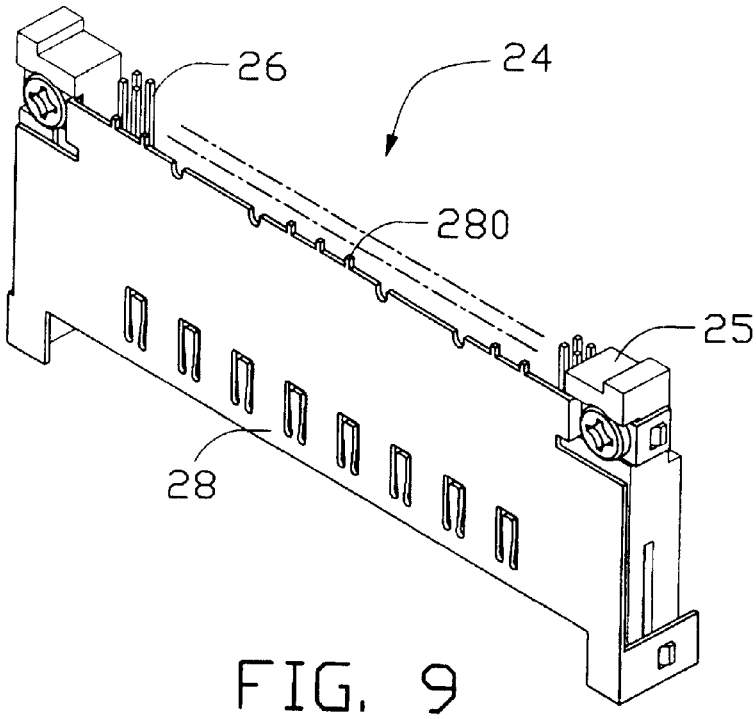
FIG. 9 is a perspective view of an lower header of the lower connector of FIG. 1.
Figure 10:
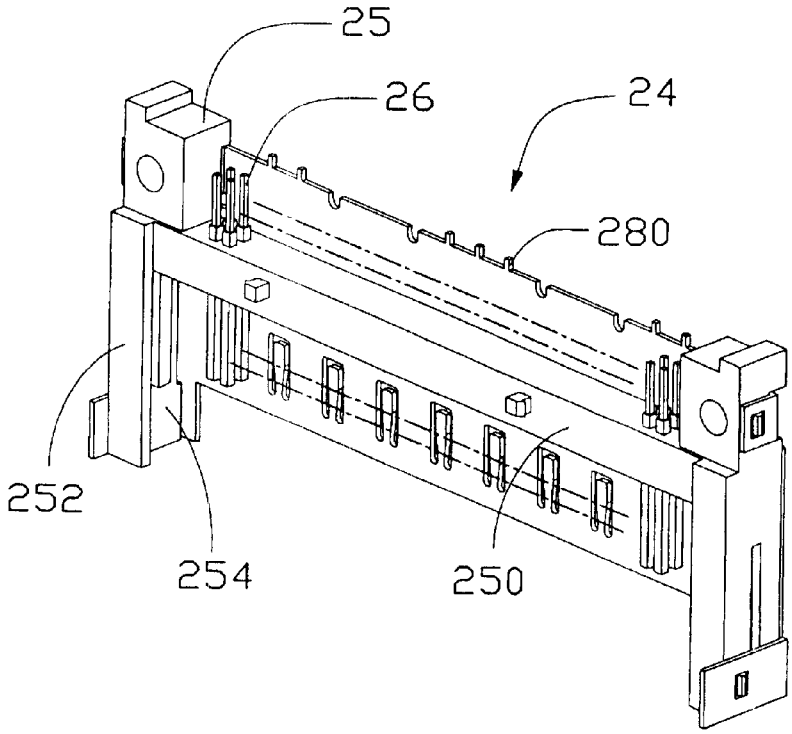
FIG. 10 is another perspective view of the lower header of FIG. 9.

Referring to FIGS. 9 and 10, a lower header 24 of the lower connector 20 comprises an insulative lower main body 25, a plurality of signal contacts 26 received in the main body 25, and a shield 28 covering the main body 25. The main body 25 has a middle bar 250, a pair of spaced upper guiding arms 252 extending towards one side of the middle bar 250. Each guiding arm 252 has a guiding slot 254 defined in a free end thereof. The signal contacts 26 are arranged in two parallel rows and inserted in the middle bar 250. The shield 28 is covered on a top surface of the main body 25 with a plurality of spaced grounding pins 280 extending from one edge of the shield 28.

Figure 11:
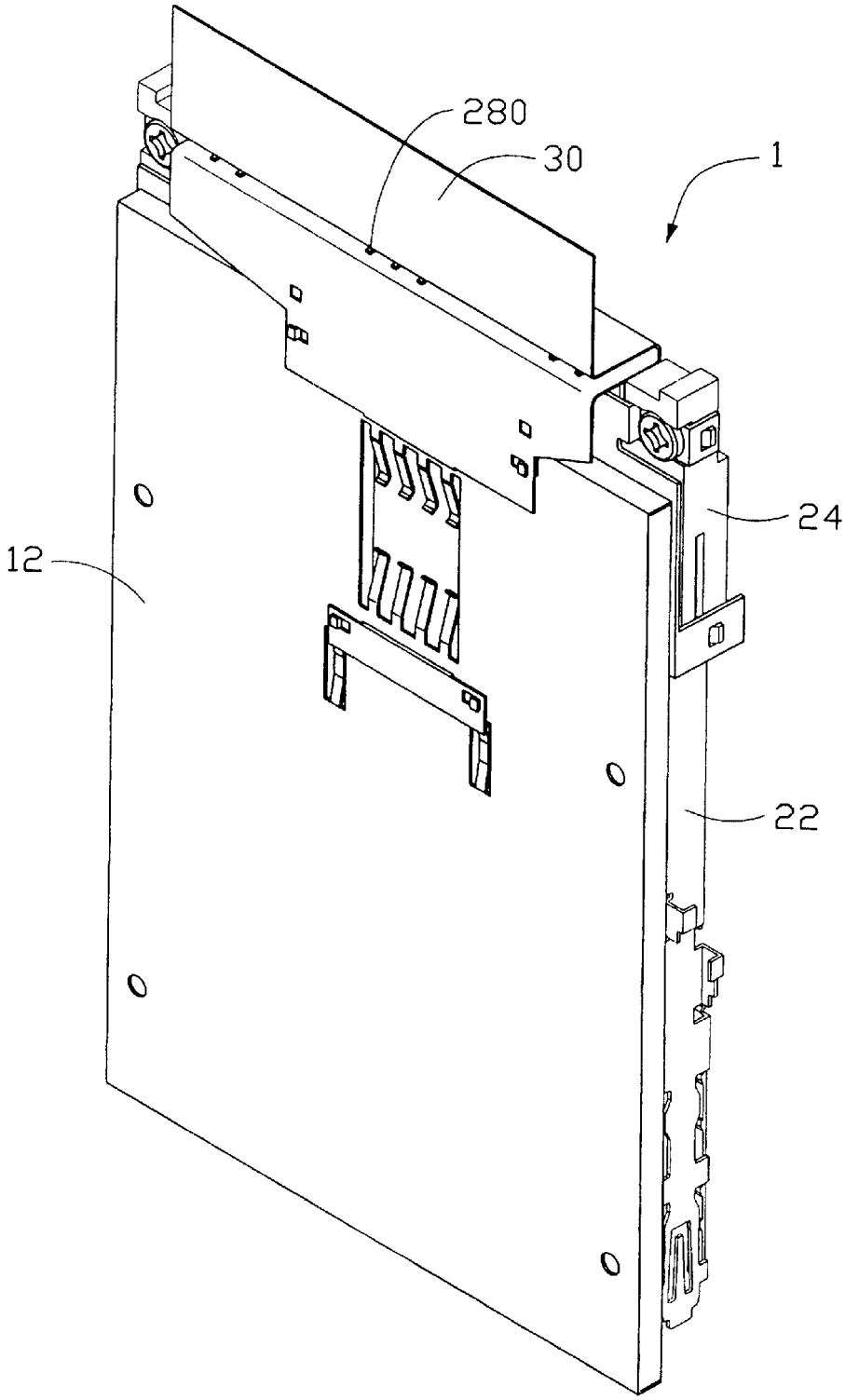
FIG. 11 is a perspective view showing the assembly of FIG. 8 assembled to the lower header of FIG. 9 to form the stacked electrical connector assembly of FIG. 1.

FIG. 11 shows the subassembly 50, which includes the upper frame 12, the lower frame 21 and the FPC 30, is assembled on the lower header 24 to form the stacked electrical connector assembly 1. The locating sheets 224 of the lower frame 21 are inserted into the guiding slots 254 of the lower header 24 with a rear portion of the upper frame 12 being stacked on the shield 28 of the lower header 24. Also, the two rows of signal contacts 26 of the upper header 24 are inserted into corresponding first solder holes 340 and the grounding pins 280 of the shield 28 are inserted into corresponding second solder holes 342. Therefore, an electrical card received in the lower connector 20 can also be communicated to outside through the FPC 30.

Referring to FIG. 1 again, when the connector assembly 1 is mounted on the PCB 2, the FPC 30 acts as a transition device therebetween. One end of the FPC 30 can simultaneously connect with the upper and lower connectors 10, 20 while the other end of the FPC 30 can connect with a plug portion 40 of a board-to-board connector 4. Therefore, after two electrical cards are respectively inserted into the upper and lower connectors 10 and 20, data stored in the electrical cards can be transferred by one transition device 30, and the transition device 30 can be expediently connected to a receptacle portion 41 of the board-to-board connector 4 mounted on the PCB 2 without additional solder process.

It is noted that the invention discloses a connection assembly including two stacked different type connectors for receivably connecting to different type cards, e.g., the Smart card in the upper connector and the PCMCIA card in the lower connector wherein the Smart card provides the contacting pads on the front portion of the planar upper(lower) face while the PCMCIA card provides the socket type contacts at the front edge thereof. Thus, the lower connector provides a plurality of pin type contacts for engagement with the corresponding socket type contacts of the PCMCIA card while the upper connector provides a plurality of spring arms incorporating the FPC for engagement with the contacting pads of the Smart card. Finally, both the upper connector and the lower connector are connected to the printed circuit board, on which the connector assembly is mounted, via the FPC and its associated connector device which is an interface between the FPC and the printed circuit board. Understandably, in the embodiment, the connector 4 includes a receptacle portion 41 and the plug portion 40. Alternately, a simplex FPC connector can replace both the receptacle portion and the plug portion.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical card connector assembly mounted on a printed circuit board (PCB), comprising:

an upper connector having a metallic upper frame, the upper frame including a pair of flanges, each flange defining a solder portion thereof, an opening and a plurality of spring arms exposed in the opening;

a lower connector having an insulative lower header, a metallic lower frame assembled to the lower header, a plurality of signal contacts received in the lower header, and a shield covering the lower header and having a plurality of grounding pins extending from an edge thereof;

the solder portions of the upper frame being soldered on the lower frame; and a transition device having a first contacting and a second contacting portion, the first contacting portion being urged by the spring arms of the upper connector, the second contacting portion being connected with the signal contacts and the grounding pins of the lower connector.

2. The stacked electrical card connector assembly as claimed in claim 1, wherein the upper frame comprises a base plate having a plurality of through holes, the solder portions of the upper frame being soldered to the lower frame through the through holes.

3. The stacked electrical card connector assembly as claimed in claim 1, wherein the transition device comprises a flexible printed circuit (FPC), and the first and the second contacting portions are defined on the FPC.

4. The stacked electrical card connector assembly as claimed in claim 3, wherein the first contacting portion has a plurality of solder pads defined on one side surface thereof, each spring arm of the upper frame bearing against the other side surface of the first contacting portion.

5. The stacked electrical card connector assembly as claimed in claim 3, wherein the second contacting portion comprises a plurality of first and second solder holes defined therethrough.

6. The stacked electrical card connector assembly as claimed in claim 5, wherein the signal contacts of the lower connector and the grounding pins of the shield are respectively received in the first and the second solder holes.

7. A stacked connector assembly comprising:

a first card connector and a second card connector stacked with each other, said first card connector defining a plurality of pin type contacts extending along a front-to-back direction for electrically connecting a PCMCIA card accommodated in said first card connector in a front-to-back direction, said second card connector defining a plurality of spring arms deflectable in a vertical direction perpendicular to said front-to-back direction, the spring arms pressing a contacting portion of a transition device for electrically connecting to a SMART CARD accommodated in said second card connector.

8. The assembly as claimed in claim 7, wherein said first card connector defines a vertical dimension larger than that of the second card connector.

9. The assembly as claimed in claim 7, wherein both said first card connector and said second card connector are electrically connected to a printed circuit board (PCB) via the transition device, wherein the transition device is a flexible printed circuit (FPC).

10. The assembly as claimed in claim 9, wherein said FPC is electrically connected to said PCB via a connection device, wherein the connection device is a board-to-board connector comprising a plug portion connected to one of said FPC and said PCB and a receptacle portion connected to the other of said FPC and said PCB.

11. The assembly as claimed in claim 9, wherein the contacting portion of said FPC comprises a first contacting portion urged by the spring arms and a second contacting portion electrically and mechanically connected to the pin type contacts.

12. The assembly as claimed in claim 11, wherein said FPC is fastened to said second card connector.

13. The assembly as claimed in claim 7, wherein said second card connector is located above said first card connector.

14. An electrical connector assembly comprising:

a first card connector and a second card connector stacked with each other, said first card connector defining a plurality of pin type contacts for use with a PCMCIA card, said second card connector defining a plurality of spring arms pressing against an FPC for use with a Smart Card wherein said FPC is electrically connected to a printed circuit board on which the connector assembly is mounted.

15. The connector assembly as claimed in claim 14, wherein said FPC electrically connects the contacts to the printed circuit board.

16. The connector assembly as claimed in claim 14, wherein said second card connector includes a metallic frame from which the spring arms extend.

* * * * *